United States Patent [19]

Sagara et al.

[11] Patent Number: 4,626,116

[45] Date of Patent: Dec. 2, 1986

[54] HEAD FOR WIRE DOT PRINTER

[75] Inventors: Takehiko Sagara, Fukaya; Hiroya Suzuki, Kumagaya; Iwao Ohtsuka, Matsue, all of Japan

[73] Assignee: Hitachi Metals, Ltd., Tokyo, Japan

[21] Appl. No.: 708,524

[22] Filed: Mar. 5, 1985

[30] Foreign Application Priority Data

Mar. 6, 1984 [JP] Japan ..... 59-42279

[51] Int. Cl.[4] ..... B41J 3/12; C22C 38/18

[52] U.S. Cl. ..... 400/124; 101/93.05; 400/694; 420/37

[58] Field of Search ..... 400/124, 694; 101/93.05, 93.48; 75/126 C

[56] References Cited

U.S. PATENT DOCUMENTS 3,772,005 11/1973 de Barbadillo ..... 75/126 C 3,826,697 7/1974 Carlen ..... 75/126 C X 4,544,406 10/1985 Yamamoto ..... 75/126 C X

*Primary Examiner*—Paul T. Sewell

*Attorney, Agent, or Firm*—Finnegan, Henderson, Farabow, Garrett & Dunner

[57] ABSTRACT

A wire dot printer head comprising a leaf spring welded to an armature and biased by a permanent magnet, and a magnetic coil adapted to erase the magnetic field of the permanent magnet so as to release the leaf spring and to drive a print wire. The leaf spring is made of an alloy which consists essentially of 13–14 wt % Cr, 0.37–0.43 wt % C, 0.25–0.5 wt % Si, 0.3–0.5 wt % Mn, 1.15–1.35 wt % Mo and the balance Fe. The alloy makes the width of the weld metal of the leaf spring wide and its depth of weld penetration deep and thus minimizes the generation of micro-cracking.

9 Claims, 7 Drawing Figures

DISTRIBUTION OF HARDNESS OF WELD METAL IN LATERAL DIRECTION

DISTRIBUTION OF HARDNESS OF CENTRAL PORTION IN WELD METAL IN DEPTH DIRECTION

HEAD FOR WIRE DOT PRINTER

BACKGROUND OF THE INVENTION

This invention relates to a wire dot printer head which drives a print wire by biasing a leaf spring and releasing the bias force of the leaf spring.

Conventionally, in wire dot printer heads of this kind, an armature has been welded at the position adjacent to the free end portion of a leaf spring by spot welding, laser welding or the like. A carbon tool steel which is superior in elasticity and fatigue resistance, such as JIS steels SK-3 to SK-5 (consisting of 0.80–1.10% C, not more than 0.35% Si, not more than 0.50% Mn, not more than 0.030% P, not more than 0.030% S, and the balance Fe), has been used as the material for a leaf spring, and a low carbon steel which has good magnetic properties has been used as a material for an armature. However, there have been caused such drawbacks that fusion due to welding causes segregation of the supersaturated carbons in the leaf spring material of a carbon tool steel, and that a change in volume caused by the change in crystal structure due to the fusion causes micro-cracking in the weld, both of which are remarkably deleterious regarding fatigue life time relating to resistance against the fatigue caused by the bending force occurring on the weld metal every time a print wire is driven to effect printing on a printing paper and the reduction of which resistance causes breakage of the leaf spring and trouble in the print head. That is, when the print wire is projected by means of the resilient force of the leaf spring, the print wire collides with carbon sheet, printing paper and a platen, so that impact results in bending of the leaf spring which bending causes the leaf spring to oscillate with fulcrums at the fixed end of the leaf spring and at the welded portion. The fixed end of the leaf spring is not damaged by this oscillation because no degradation is caused in the fixed end. But, if the welded portion has any micro-cracks or segregation of carbon, repeated oscillation causes fatigue on the leaf spring and then causes cracks of the spring. Thus, there are required regarding the properties of wire dot printer head not only such matter that the leaf spring can be firmly welded to an armature but also such matter that the welded portion has large fatigue resistance.

As to a material for leaf spring of a wire dot printer head, Japanese Patent Laid-Open Publication No. 3952/1983 has disclosed that 17-7 precipitation-hardened stainless steel plate consisting of 16.4 to 17.5 wt % Cr, 6.5 to 7.5 wt % Ni, 0.9 to 1.4 wt % Al, 0.06 to 0.08 wt % C, 0.4 to 0.9 wt % Mn, 0.15 to 0.64 wt % Si and the balance being Fe has resilient force and fatigue resistance similar to conventional carbon tool steel (JIS steels SK-3 to SK-5) and has better resistance to heat deterioration caused due to welding. Although the 17-7 precipitation-hardened type leaf spring shows some excellent properties, it is inferior to the carbon tool steel in the matter of resistance to repeated impact.

SUMMARY OF THE INVENTION

Accordingly it is an object of this invention to remove these drawbacks.

To this end, in a head for a wire dot printer according to the invention, a leaf spring is made of a particular material having not only elasticity and fatigue resistance both equivalent to those of the conventional carbon tool steel but also superior property able to minimize heat deterioration caused by welding, that is, the leaf spring is made of an alloy which consists essentially of 13–14 wt % Cr, 0.37–0.43 wt % C, 0.25–0.5 wt % Si, 0.3–0.5 wt % Mn, 1.15–1.35 wt % Mo and the balance Fe. An armature to be welded to the leaf spring is made of an 1% silicon steel consisting of not more than 0.02% C, 0.9–1.3% Si, not more than 0.35% Mn, not more than 0.03% P, not more than 0.03% S and the balance Fe.

It is preferred to control the amount of P and S which are usually contained as impurity elements such that phosphorus is not greater than 0.025 wt % and sulfur is not greater than 0.002 wt %.

This invention can minimize the occurrence of cavities and micro-crackings caused by welding and increase the strength of the weld.

The above and other objects, features and advantages of the present invention will become clear from the following description of the preferred embodiments thereof, taken in conjunction with the accompanying drawings.

DESCRIPTION OF THE PREFERRED EMBODIMENT

Hereinunder, the invention will be described in detail with reference to the drawings and the experimental data.

Figure 1:
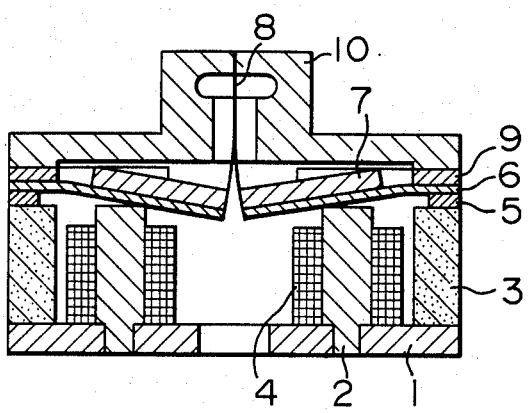
FIG. 1 is a sectional view of a wire dot head embodying the invention.

FIG. 1 is a sectional view of an embodiment of a wire dot printer head according to the invention. Referential numeral 1 represents a first yoke which forms a common magnetic path, 2 a core which is secured to the upper surface of the first yoke 1, 3 a permanent magnet which also serves as a housing, 4 a demagnetizing coil disposed in the magnetic path of the permanent magnet 3 which coil demagnetizes the magnetic field of the permanent magnet 3, 5 a spacer of a thickness equal to a desired gap, 6 an approximately circular leaf spring having a plurality of arms which radially extend in the central direction, 7 an armature working member welded to the vicinity of the free end portion of the leaf spring 6, 8 a print wire welded to the forward end of the armature 7, 9 a second yoke overlaid on the upper surface of the leaf spring 6, and 10 a guide frame overlaid on the second yoke 9.

The operation of the dot head of this structure will be explained below.

While the demagnetizing coil 4 is not energized, the magnetic flux of the permanent magnet 3 passes the spacer 5, the leaf spring 6, the second yoke 9, the armature 7, the core 2 and the first yoke 1, and the magnetic attractive force generated at this time attracts the armature 7 to the core 2 and makes the leaf spring 6 biased. Thereafter when the demagnetizing coil 4 is energized to cause magnetic flux in the core 2 in the direction opposite to the magnetic flux caused by the permanent magnets 3, the magnetic flux of the permanent magnet 3 is erased and the magnetic attractive force decreases or disappear. The armature 7 therefore moves away from the core 2 by virtue of the restoring force of the leaf spring 6 and the print wire 8 projects from the guide frame 10. When the demagnetizing coil 4 is again brought to the de-energized state, the armature 7 is attracted to the core again in the above-described manner, and the leaf spring 6 is biased.

Figure 2A:
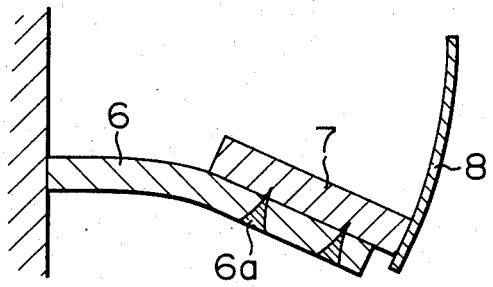
FIGS. 2(*a*) and 2(*b*) are explanation views of the action of the wire dot printer head shown in FIG. 1.
Figure 2B:
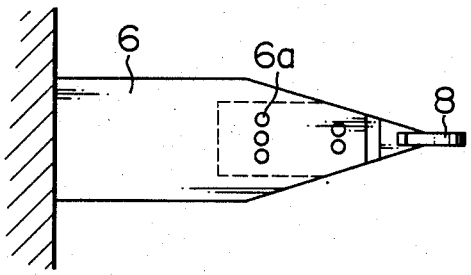

When the leaf spring 6 is bent in this way, as is shown in FIGS. 2(*a*) and 2(*b*), a large bending moment is applied to the weld metal 6*a* in the leaf spring 6 at which weld metal the leaf spring 6 is welded to the armature 7, but if a leaf spring material according to the invention is used, there is minimized deterioration caused by the fusion of the weld metal 6*a*, so that breakage of the leaf spring 6 at the weld 6*a* is substantially prevented.

Figure 3:
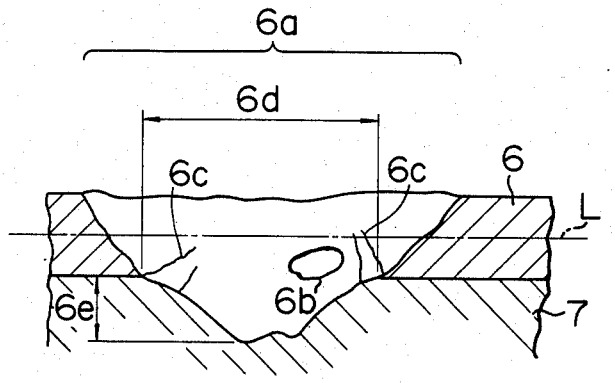
FIG. 3 is a sectional view of the weld metal in a leaf spring for which the conventional material is used.

FIG. 3 shows a section of a weld metal in a leaf spring of the conventional carbon tool steel material having a thickness of 0.4 mm which is subjected to laser welding so that the leaf spring may be bonded to an armature 7 having a thickness of 1.6 mm and a width of 2.5 mm. Regarding the laser welding, there is used NdYAG laser having a wave length of 1.06 μm, a plus width of 8 sec and having energy of 11 Joule/pulse. When a carbon tool steel is used as the material for the leaf spring, a cavity 6*b* and micro-cracking 6*c* are caused in the weld metal 6*a*, as is shown in FIG. 3. The micro-crackings 6*c* start from the boundary between the weld metal and the armature. By decreasing the output of the laser it becomes possible to suppress the occurrence of the cavity 6*b*, but such decrease cannot suppress the occurrence of the micro-cracking 6*c*. Further, a lower output of the laser decreases the area of the molten pool and the depth of weld penetration 6*e* with the result that resistance to bending force is degraded.

By analyzing the components of the weld metal 6*a*, it is found that a remarkable degree of carbon segregation occurs especially in the portion where micro-cracking 6*c* is caused. There is considered such reason for this phenomenon that, since the carbon contained in the carbon tool steel is supersaturated inherently, when the leaf spring 6 and the armature 7 are melted in laser irradiation, the carbon is segregated during the course of cooling. When a dot wire repeatedly collides with a platen or printing paper, resultant leaf spring oscillation due to the impact causes the micro-crackings 6*c* to grow and finally destroys the welded portion in the leaf spring.

Figure 4:
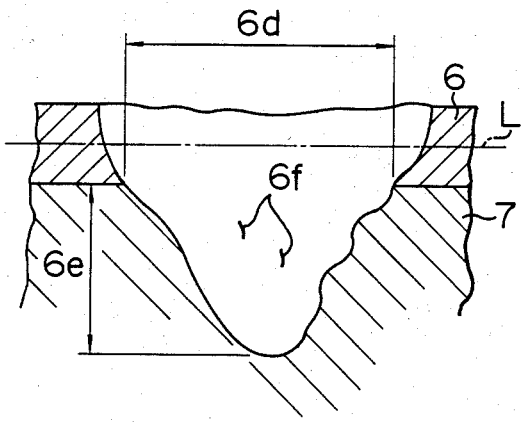
FIG. 4 is a sectional view of the weld metal in a leaf spring for which a material according to the invention is used.

FIG. 4 shows a section of a weld metal of a leaf spring which is made of the material according to the invention and is welded under the same laser welding condition as the case shown in FIG. 3. There is no occurrence of cavity 6*b* in the carbon tool steel. The micro-cracking 6*c* is very small in size as compared with the case of the conventional carbon tool steel. Furthermore, under the same welding conditions as in the carbon tool steel, the material according to the invention increases both the width 6*d* of the weld and the depth 6*e* of weld penetration.

Figure 5:
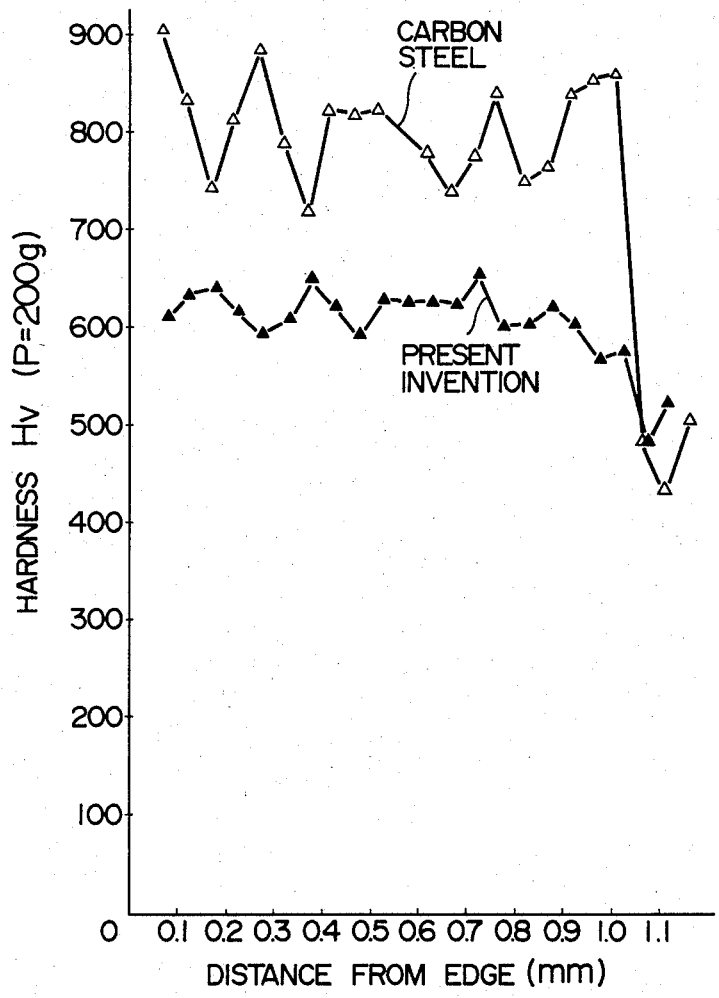
FIGS. 5 and 6 are graphs showing distribution of hardness measured regarding a welded portion.
Figure 6:
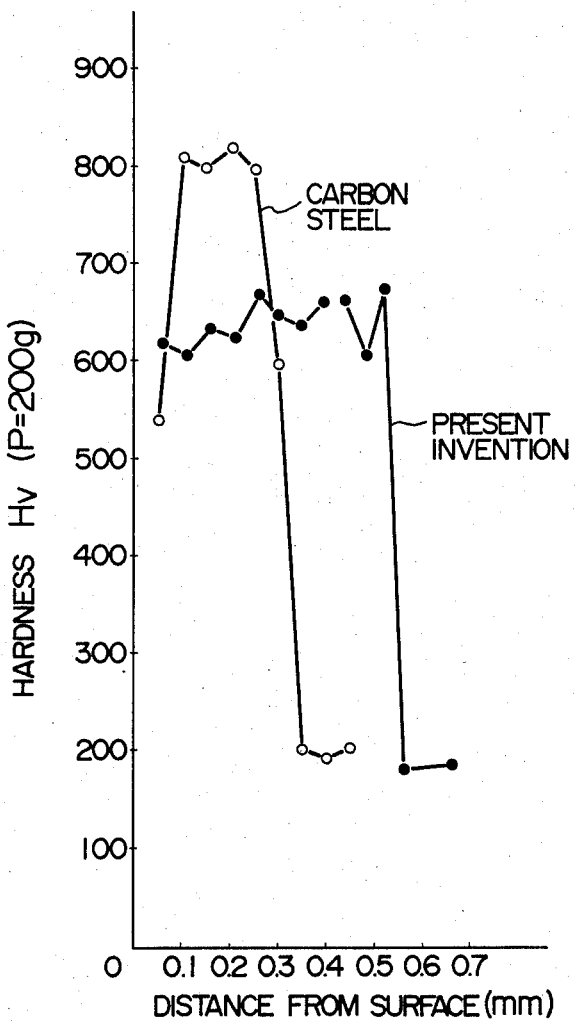

FIGS. 5 and 6 show the distribution of hardness measured regarding the welded portion. In FIG. 5, the abscissa thereof designates a distance in millimeter from the edge of the leaf spring to a portion at which the hardness is measured. In the case of the carbon tool steel leaf spring shown by white triangles, the welded portion has hardness value of about 800 Hv which is twice as large as the hardness value at a non-welded portion. On the other hand, in the case of the present invention shown by black triangles, the hardness of the welded portion is slightly larger than that of the non-welded portion, that is, the hardness of the welded portion is at the approximately same level as that of the non-welded portion.

In FIG. 6, the abscissa thereof designates a depth in millimeter from the surface of the weld metal to a portion at which the hardness is measured. The portion having extremely lower hardness value is of the armature. From FIG. 6 it is apparent that the weld metal in the present invention shown by black circular marks is larger in depth than that of the conventional carbon tool steel shown by white circular marks.

The mild hardness of the welded portion in the present invention results in superior fatigue resistance and can withstand oscillation caused due to impact of dot wire against a platen or printing paper.

As described before, since in a wire dot printer head according to this invention there is provided a leaf spring having the above-described particular composition, the welding width of the weld metal in the leaf spring is wide and its welding depth thereof is deep, with the result that the occurrence of micro-cracking is minimized, fatigue life time at the joint of the armature and the leaf spring increasing and trouble of the wire dot head being minimized. That is, the wire dot printer head embodying the present invention can be used without any trouble even after the lapse of dotting repetition of $1500\times10^6$ times, while another wire dot printer head of conventional technique causes breakage after the dotting repetition of $4\times10^6$ to $20\times10^6$ times.

While there has been described what is at present considered to be a preferred embodiment of the invention, it will be understood that various modifications may be made therein, and it is intended that the appended claims cover all such modifications as fall within the true spirit and scope of the invention.

What is claimed is:

1. A head for a spring charge type wire dot printer comprising:
   - a leaf spring welded to an armature and biased by a permanent magnet; and
   - a magnetic coil adapted to erase the magnetic field of said permanent magnet so as to release said leaf spring and to drive a print wire;
   - said leaf spring being made of an alloy consisting essentially of 13–14 wt % Cr, 0.37–0.43 wt % C, 0.25–0.5 wt % Si, 0.3–0.5 wt %, Mn, 1.15–1.35 wt % Mo and the balance Fe.

2. A head for a spring charge type wire dot printer as set forth in claim 1, wherein the leaf spring is welded to the armature by laser welding.

3. A head for a spring charge type wire dot printer as set force in claim 1, the armature being made of an alloy consisting essentially of not more than 0.02 wt % C, 0.9–1.3 wt % Si, not more than 0.35 wt % Mn, not more than 0.03 wt % P, not more than 0.03 wt % S, and the balance Fe.

4. A weldable, iron-based spring material consisting essentially of 13–14 wt % Cr, 0.37–0.43 wt % C, 0.25–0.5 wt % Si, 0.3–0.5 wt % Mn, 1.15–1.35 wt % Mo and the balance Fe.

5. A fatigue resistant welded spring assembly comprising:
   - a spring member;
   - a metal working member welded to a portion of said spring member, said spring member portion being subjectable to bending stresses during activation of said spring member, wherein said spring member is made of an alloy consisting essentially of 13–14 wt % Cr, 0.37–0.43 wt % C, 0.25–0.5 wt % Si, 0.3–0.5 wt % Mn, 1.15–1.35 wt % Mo and the balance Fe.

6. The spring assembly as in claim 5 wherein said working member is made of an alloy consisting essentially of not more than 0.02 wt % C, 0.9–1.3 wt % Si, not more than 0.35 wt % Mn, not more than 0.03 wt % P, not more than 0.03 wt % S, and the balance Fe.

7. The spring assembly as in claim 5 wherein said spring member is a leaf spring.

8. The spring assembly as in claim 5 wherein said spring member is welded to said working member by laser welding.

9. The spring assembly as in claim 5 wherein said working member is magnetically attractable.

* * * * *